US006698864B2

(12) United States Patent
Therien

(10) Patent No.: US 6,698,864 B2
(45) **Date of Patent: *Mar. 2, 2004**

(54) INK DROP DETECTOR WASTE INK REMOVAL SYSTEM

(75) Inventor: Patrick J. Therien, Battle Ground, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/231,864

(22) Filed: Aug. 29, 2002

(65) Prior Publication Data

US 2003/0035018 A1 Feb. 20, 2003

Related U.S. Application Data

(63) Continuation of application No. 09/933,688, filed on Aug. 20, 2001, now Pat. No. 6,491,366.

(51) Int. Cl.[7] ..... B41J 2/165
(52) U.S. Cl. ..... 347/22; 347/33
(58) Field of Search ..... 347/22, 29–33, 347/36

(56) References Cited

U.S. PATENT DOCUMENTS

| | | | | | |
|---|---|---|---|---|---|
| 4,768,045 | A | * | 8/1988 | Koto | 346/140 R |
| 5,255,009 | A | * | 10/1993 | Bauer et al. | 347/22 |
| 5,557,306 | A | * | 9/1996 | Fukushima et al. | 347/33 |
| 5,774,139 | A | * | 6/1998 | Salzer et al. | 347/32 |
| 5,997,128 | A | * | 12/1999 | Lou et al. | 347/33 |
| 6,250,736 | B1 | * | 6/2001 | Wojcik | 347/33 |
| 6,479,182 | B1 | * | 11/2002 | Mercuri | 429/44 |
| 6,491,366 | B1 | * | 12/2002 | Therien | 347/22 |

* cited by examiner

*Primary Examiner*—Stephen D. Meier
*Assistant Examiner*—An H. Do

(57) ABSTRACT

A waste ink removal system cleans ink residue from an ink drop sensor in a printing mechanism when a scraper, supported by a base, is actuated between a retracted position and an engaged position. The system also includes a reservoir defining a plurality of capillary drains onto which the scraper deposits ink residue while moving to the engaged position. A method of cleaning ink residue from an electrostatic sensing element of an ink drop detector, and a printing mechanism having such a waste ink removal system are also provided.

69 Claims, 5 Drawing Sheets

INK DROP DETECTOR WASTE INK REMOVAL SYSTEM

CROSS REFERENCE TO RELATED APPLICATION(S)

This is a continuation of application Ser. No. 09/933,688 filed on Aug. 20, 2001, now U.S. Pat. No. 6,491,366, which is hereby incorporated by reference herein.

INTRODUCTION

Printing mechanisms, such as inkjet printers or plotters, often include an inkjet printhead which is capable of forming an image on many different types of media. The inkjet printhead ejects droplets of colored ink through a plurality of orifices and onto a given media as the media is advanced through a printzone. The printzone is defined by the plane created by the printhead orifices and any scanning or reciprocating movement the printhead may have back-and-forth and perpendicular to the movement of the media. Conventional methods for expelling ink from the printhead orifices, or nozzles, include piezo-electric and thermal techniques which are well-known to those skilled in the art. For instance, two earlier thermal ink ejection mechanisms are shown in U.S. Pat. Nos. 5,278,584 and 4,683,481, both assigned to the present assignee, the Hewlett-Packard Company.

In a thermal inkjet system, a barrier layer containing ink channels and vaporization chambers is located between a nozzle orifice plate and a substrate layer. This substrate layer typically contains columnar arrays of heater elements, such as resistors, which are individually addressable and energized to heat ink within the vaporization chambers. Upon heating, an ink droplet is ejected from a nozzle associated with the energized resistor. The inkjet printhead nozzles are typically aligned in one or more columnar arrays substantially parallel to the motion of the print media as the media travels through the printzone. The length of the columnar nozzle arrays defines the maximum height, or "swath" height of an imaged bar that would be printed in a single pass of the printhead across the media if all of the nozzles were fired simultaneously and continuously as the printhead was moved through the printzone above the media.

Typically, the print media is advanced under the inkjet printhead and held stationary while the printhead passes along the width of the media, firing its nozzles as determined by a controller to form a desired image on an individual swath, or pass. The print media is usually advanced between passes of the reciprocating inkjet printhead in order to avoid uncertainty in the placement of the fired ink droplets. If the entire printable data for a given swath is printed in one pass of the printhead, and the media is advanced a distance equal to the maximum swath height in-between printhead passes, then the printing mechanism will achieve its maximum throughput.

Often, however, it is desirable to print only a portion of the data for a given swath, utilizing a fraction of the available nozzles and advancing the media a distance smaller than the maximum swath height so that the same or a different fraction of nozzles may fill in the gaps in the desired printed image which were intentionally left on the first pass. This process of separating the printable data into multiple passes utilizing subsets of the available nozzles is referred to by those skilled in the art as "shingling," "masking," or using "print masks." While the use of print masks does lower the throughput of a printing system, it can provide offsetting benefits when image quality needs to be balanced against speed. For example, the use of print masks allows large solid color areas to be filled in gradually, on multiple passes, allowing the ink to dry in parts and avoiding the large-area soaking and resulting ripples, or "cockle," in the print media that a single pass swath would cause.

A printing mechanism may have one or more inkjet printheads, corresponding to one or more colors, or "process colors" as they are referred to in the art. For example, a typical inkjet printing system may have a single printhead with only black ink; or the system may have four printheads, one each with black, cyan, magenta, and yellow inks; or the system may have three printheads, one each with cyan, magenta, and yellow inks. Of course, there are many more combinations and quantities of possible printheads in inkjet printing systems, including seven and eight ink/printhead systems.

Each process color ink is ejected onto the print media in such a way that the drop size, relative position of the ink drops, and color of a small, discreet number of process inks are integrated by the naturally occurring visual response of the human eye to produce the effect of a large colorspace with millions of discernable colors and the effect of a nearly continuous tone. In fact, when these imaging techniques are performed properly by those skilled in the art, near-photographic quality images can be obtained on a variety of print media using only three to eight colors of ink.

This high level of image quality depends on many factors, several of which include: consistent and small ink drop size, consistent ink drop trajectory from the printhead nozzle to the print media, and extremely reliable inkjet printhead nozzles which do not clog.

To this end, many inkjet printing mechanisms contain a service station for the maintenance of the inkjet printheads. These service stations may include scrapers, ink-solvent applicators, primers, and caps to help keep the nozzles from drying out during periods of inactivity. Additionally, inkjet printing mechanisms often contain service routines which are designed to fire ink out of each of the nozzles and into a waste spittoon in order to prevent nozzle clogging.

Despite these preventative measures, however, there are many factors at work within the typical inkjet printing mechanism which may clog the inkjet nozzles, and inkjet nozzle failures may occur. For example, paper dust may collect on the nozzles and eventually clog them. Ink residue from ink aerosol or partially clogged nozzles may be spread by service station printhead scrapers into open nozzles, causing them to be clogged. Accumulated precipitates from the ink inside of the printhead may also occlude the ink channels and the nozzles. Additionally, the heater elements in a thermal inkjet printhead may fail to energize, despite the lack of an associated clogged nozzle, thereby causing the nozzle to fail.

Clogged or failed printhead nozzles result in objectionable and easily noticeable print quality defects such as banding (visible bands of different hues or colors in what would otherwise be a uniformly colored area) or voids in the image. In fact, inkjet printing systems are so sensitive to clogged nozzles, that a single clogged nozzle out of hundreds of nozzles is often noticeable and objectionable in the printed output.

It is possible, however, for an inkjet printing system to compensate for a missing nozzle by removing it from the printing mask and replacing it with an unused nozzle or a used nozzle on a later, overlapping pass, provided the inkjet system has a way to tell when a particular nozzle is not functioning. In order to detect whether an inkjet printhead nozzle is firing, a printing mechanism may be equipped with a number of different ink drop detector systems.

One type of ink drop detector system utilizes a piezoelectric target surface that produces a measurable signal when ink droplets contact the target surface. Unfortunately, however, this type of technology is expensive and often is unable to detect the extremely small drops of ink used in inkjet printing systems with photographic image quality.

Another type of ink drop detector utilizes an optical sensor which forms a measurable signal when an ink droplet passes through a light beam from a sensory circuit. Unfortunately, this method is subject to extremely tight alignment tolerances which are difficult and expensive to setup and maintain. Additionally, an optical ink drop detection system is susceptible to the ink aerosol which results from the firing of the inkjet printhead inside of the printing mechanism. The aerosol coats the optical sensor over time, degrading the optical sensor signal and eventually preventing the optical sensor from functioning.

A more effective solution for ink drop detection is to use a low cost ink drop detection system, such as the one described in U.S. Pat. No. 6,086,190 assigned to the present assignee, Hewlett-Packard Company. This drop detection system utilizes an electrostatic sensing element which is imparted with an electrical stimulus when struck by a series of ink drop bursts ejected from an inkjet printhead. The electrostatic sensing element may be made sufficiently large so that printhead alignment is not critical, and the sensing element may function with amounts of ink or aerosol on the sensing element surface which would incapacitate other types of drop detection sensors.

In practical implementation, however, this electrostatic sensing element has some limitations. First, successive drops of ink, drying on top of one another quickly form stalagmites of dried ink which may grow toward the printhead. Since it is preferable to have the electrostatic sensing element very close to the printhead for more accurate readings, these stalagmites may eventually interfere with or permanently damage the printhead, adversely affecting print quality. Second, as the ink residue dries, it remains conductive and may short out the drop detector electronics as the ink residue grows and spreads. Thus, this dried residue may impair the ability of the sensor to measure the presence of drops properly.

Therefore, it is desirable to have a method and mechanism for effectively removing the waste ink residue from an electrostatic ink drop detector in an inkjet printing mechanism.

DETAILED DESCRIPTION OF THE PREFERRED EMBODIMENTS

Figure 1:
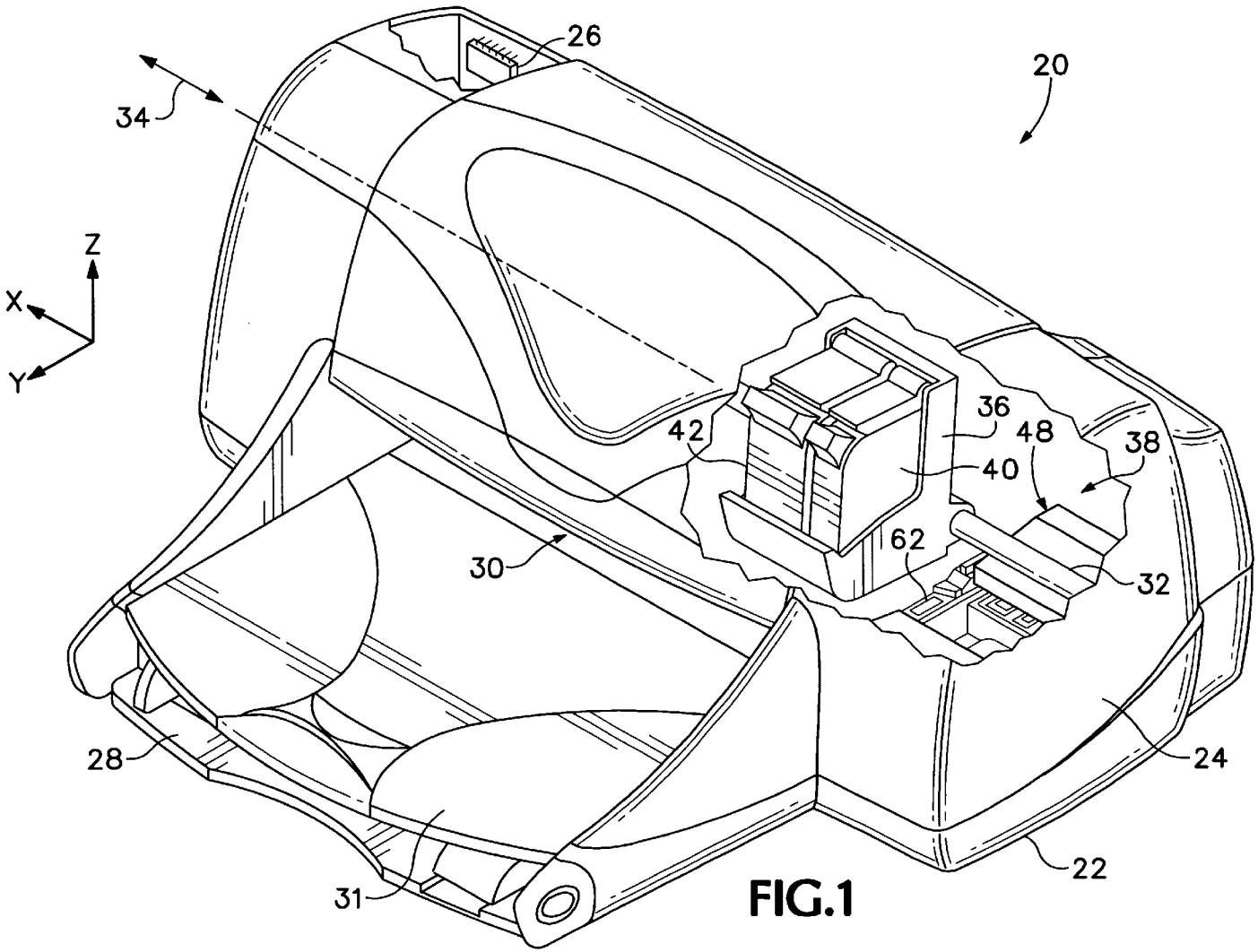
FIG. 1 is a fragmented perspective view of one form of an inkjet printing mechanism, here including a service station having an electrostatic ink drop detector and illustrating an embodiment of an electrostatic ink drop detector waste ink removal system.

FIG. 1 illustrates an embodiment of a printing mechanism, here shown as an inkjet printer 20, constructed in accordance with the present invention, which may be used for printing on a variety of media, such as paper, transparencies, coated media, cardstock, photo quality papers, and envelopes in an industrial, office, home or other environment. A variety of inkjet printing mechanisms are commercially available. For instance, some of the printing mechanisms that may embody the concepts described herein include desk top printers, portable printing units, wide-format printers, hybrid electrophotographic-inkjet printers, copiers, cameras, video printers, and facsimile machines, to name a few. For convenience the concepts introduced herein are described in the environment of an inkjet printer 20.

While it is apparent that the printer components may vary from model to model, the typical inkjet printer 20 includes a chassis 22 surrounded by a frame or casing enclosure 24, typically of a plastic material. The printer 20 also has a printer controller, illustrated schematically as a microprocessor 26, that receives instructions from a host device, such as a computer or personal digital assistant (PDA) (not shown). A screen coupled to the host device may also be used to display visual information to an operator, such as the printer status or a particular program being run on the host device. Printer host devices, such as computers and PDA's, their input devices, such as a keyboards, mouse devices, stylus devices, and output devices such as liquid crystal display screens and monitors are all well known to those skilled in the art.

A conventional print media handling system (not shown) may be used to advance a sheet of print media (not shown) from the media input tray 28 through a printzone 30 and to an output tray 31. A carriage guide rod 32 is mounted to the chassis 22 to define a scanning axis 34, with the guide rod 32 slidably supporting an inkjet carriage 36 for travel back and forth, reciprocally, across the printzone 30. A conventional carriage drive motor (not shown) may be used to propel the carriage 36 in response to a control signal received from the controller 26. To provide carriage positional feedback information to controller 26, a conventional encoder strip (not shown) may be extended along the length of the printzone 30 and over a servicing region 38. A conventional optical encoder reader may be mounted on the back surface of printhead carriage 36 to read positional information provided by the encoder strip, for example, as described in U.S. Pat. No. 5,276,970, also assigned to the Hewlett-Packard Company, the present assignee. The manner of providing positional feedback information via the encoder strip reader may also be accomplished in a variety of ways known to those skilled in the art.

In the printzone 30, the media sheet receives ink from an inkjet cartridge, such as a black ink cartridge 40 and a color inkjet cartridge 42. The black ink cartridge 40 is illustrated herein as containing a pigment-based ink. For the purposes of illustration, color cartridge 42 is described as containing three separate dye-based inks which are colored cyan, magenta, and yellow, although it is apparent that the color cartridge 42 may also contain pigment-based inks in some implementations. It is apparent that other types of inks may also be used in the cartridges 40 and 42, such as paraffin-based inks, as well as hybrid or composite inks having both dye and pigment characteristics. The illustrated printer 20 uses replaceable printhead cartridges where each cartridge has a reservoir that carries the entire ink supply as the printhead reciprocates over the printzone 30. As used herein, the term "cartridge" may also refer to an "off-axis" ink delivery system, having main stationary reservoirs (not shown) for each ink (black, cyan, magenta, yellow, or other colors depending on the number of inks in the system) located in an ink supply region. In an off-axis system, the cartridges may be replenished by ink conveyed through a conventional flexible tubing system from the stationary main reservoirs which are located "off-axis" from the path of printhead travel, so only a small ink supply is propelled by carriage 36 across the printzone 30. Other ink delivery or fluid delivery systems may also employ the systems described herein, such as replaceable ink supply cartridges which attach onto print cartridges having permanent or semi-permanent print heads.

The illustrated black cartridge 40 has a printhead 44, and color cartridge 42 has a tri-color printhead 46 which ejects cyan, magenta, and yellow inks. The printheads 44, 46 selectively eject ink to form an image on a sheet of media when in the printzone 30. The printheads 44, 46 each have an orifice plate with a plurality of nozzles formed therethrough in a manner well known to those skilled in the art. The nozzles of each printhead 44, 46 are typically formed in at least one, but typically two columnar arrays along the orifice plate. Thus, the term "columnar" as used herein may be interpreted as "nearly columnar" or substantially columnar, and may include nozzle arrangements slightly offset from one another, for example, in a zigzag arrangement. Each columnar array is typically aligned in a longitudinal direction perpendicular to the scanning axis 34, with the length of each array determining the maximum image swath for a single pass of the printhead. The printheads 44, 46 are illustrated as thermal inkjet printheads, although other types of printheads, or ink drop generators may be used, such as piezoelectric printheads. The thermal printheads 44, 46 typically include a plurality of resistors which are associated with the nozzles. Upon energizing a selected resistor, a bubble of gas is formed which ejects a droplet of ink from the nozzle and onto the print media when in the printzone 30 under the nozzle. The printhead resistors are selectively energized in response to firing command control signals delivered from the controller 26 to the printhead carriage 36.

Between print jobs, the inkjet carriage 36 moves along the carriage guide rod 32 to the servicing region 38 where a service station 48 may perform various servicing functions known to those in the art, such as, priming, scraping, and capping for storage during periods of non-use to prevent ink from drying and clogging the inkjet printhead nozzles.

Figure 2:
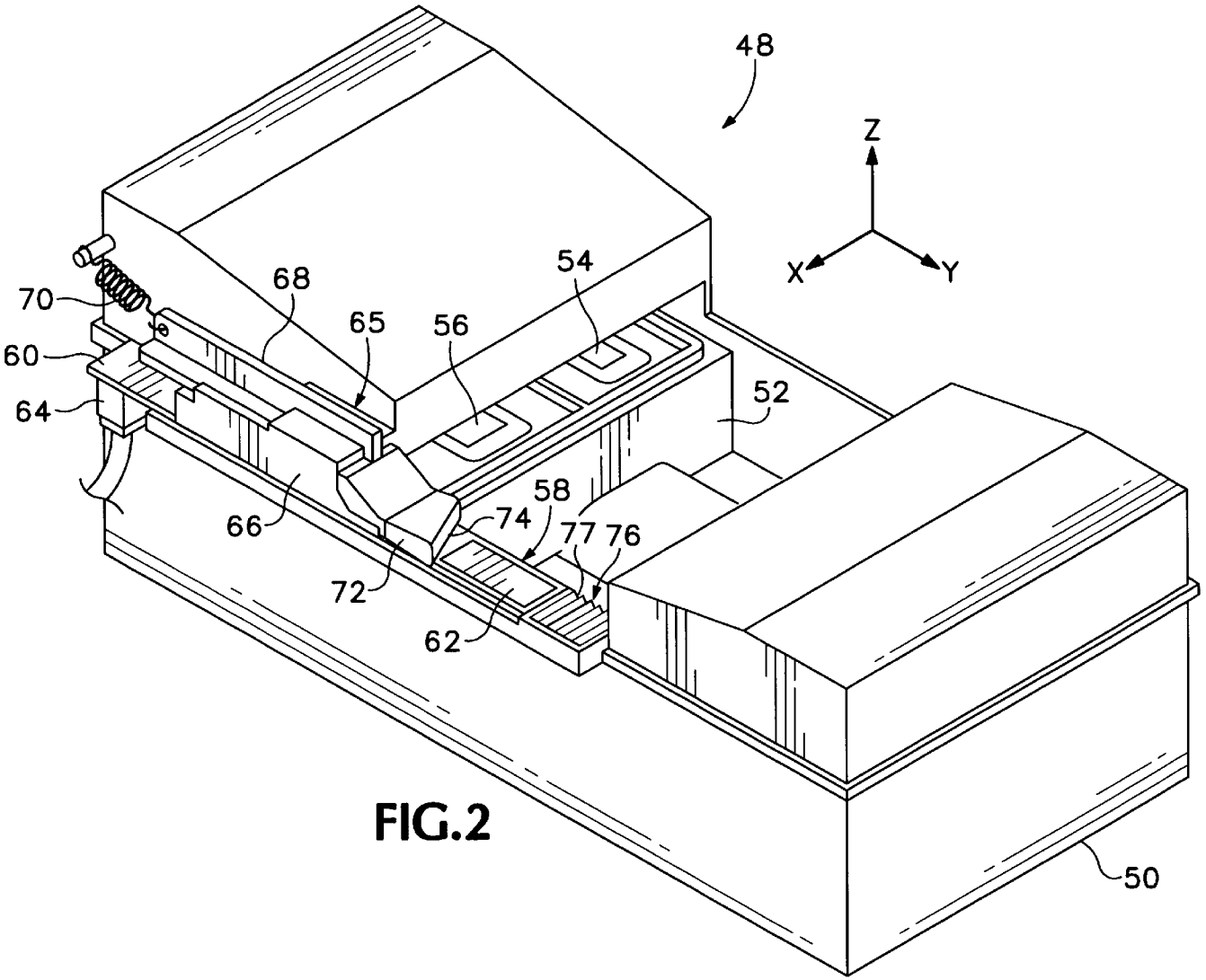
FIG. 2 is an enlarged perspective view of the service station of FIG. 1

FIG. 2 shows the service station 48 in detail. A service station frame 50 is mounted to the chassis 22, and houses a moveable pallet 52. The moveable pallet 52 may be driven by a motor (not shown) to move in the frame 50 in the positive and negative Y-axis directions. The moveable pallet 52 may be driven by a rack and pinion gear powered by the service station motor in response to the microprocessor 26 according to methods known by those skilled in the art. An example of such a rack and pinion system in an inkjet cleaning service station can be found in U.S. Pat. No. 5,980,018, assigned to the Hewlett-Packard Company, also the current assignee. The end result is that pallet 52 may be moved in the positive Y-axis direction to a servicing position and in the negative Y-axis direction to an uncapped position. The pallet 52 supports a black printhead cap 54 and a tricolor printhead cap 56 to seal the printheads 44 and 46, respectively, when the moveable pallet 52 is in the servicing position, here a capping position.

FIG. 2 also shows an ink drop detector system 58 supported by the service station frame 50. Clearly, the ink drop detector system 58 could be mounted in other locations along the printhead scanning axis 34, including the right side of the service station frame 50, inside the service station 48, or the opposite end of the printer from the service station 48, for example. However, the illustrated location of the ink drop detector 58 is the preferred location, and will be used to illustrate the preferred principles of manufacture and operation, although other locations may be more suitable in other implementations.

The ink drop detector system 58 has a printed circuitboard assembly (PCA) 60 which is supported by the service station frame 50. The PCA 60 has a conductive electrostatic sensing element 62, or "target" on the upper forward end onto which ink droplets may be fired and detected according to the apparatus and method described in U.S. Pat. No. 6,086,190, assigned to the Hewlett-Packard Company, the present assignee. The target 62 is preferably constructed of gold. The PCA 60 contains various electronics (not shown) for filtering and amplification of drop detection signals received from the target 62. An electrical conductor 64 links the ink drop detector 58 to controller 26 for drop detection signal processing. The ink drop detector system 58 also has a waste ink removal system 65.

Attached to the PCA 60 is a stationary slider cover 66 which acts as a guide for the movement of a scraper slider 68. The slider cover 66 may also be designed to shield electrical components on the ink drop detector 58 from ink aerosol generated from the printheads 44, 46. The scraper slider 68 is capable of being moved in the positive and negative Y-axis directions, and is biased towards the rear of the service station 48 (negative Y-axis direction) by a biasing member, such as a tension spring or return spring 70, which is connected between the scraper slider 68 and a post projecting from the service station frame 50. The scraper slider 68 has a scraper 72 attached or preferably overmolded onto a front end of the slider 68. The front edge 74 of scraper 72 may be angled back (in the negative Y-axis and negative X-axis directions) towards the service station 48 as illustrated in FIG. 2. This angled front edge 74 of the wiper helps to push ink and ink residue into the service station as well as providing a smooth transition while traveling over a capillary drain surface 76 which will be discussed shortly. The width of scraper 72 is sufficient to scrape the entire width of the target 62. The scraper 72 is preferably constructed of an elastomer, such as a thermoplastic elastomer (TPE) which is overmolded onto the slider 68. The scraper 72 may also be constructed of a non-overmolded, rigid one-piece plastic. Additionally, the scraper 72 may be pressed onto the slider 68 as a separate part. Other methods of coupling a scraper 72 to the slider 68 will readily be apparent to those skilled in the art, and those methods are intended to be covered by the scope of this specification. The return spring 70 is preferably mounted at an angle above the slider 68 in order to impart a minimal downward scraping force to scraper 72, thereby minimizing the wear of target 62. The ink drop detector 58 also includes a capillary drain surface 76 which may be molded as part of frame 50 or coupled to frame 50. The capillary drain surface 76 is a reservoir configured to receive ink scraped from the electrostatic sensing element 62 when the scraper 72 is moved in the positive Y-axis direction across the sensing element 62 and over the capillary drain surface 76. Capillary drain surface 76 has channels 77 formed in the top of the capillary drain surface 76. The channels 77 may vary in cross-sectional shape, depth, and spacing. Each channel 77 leads to and may be fluidically coupled to the service station 48.

Figure 3:
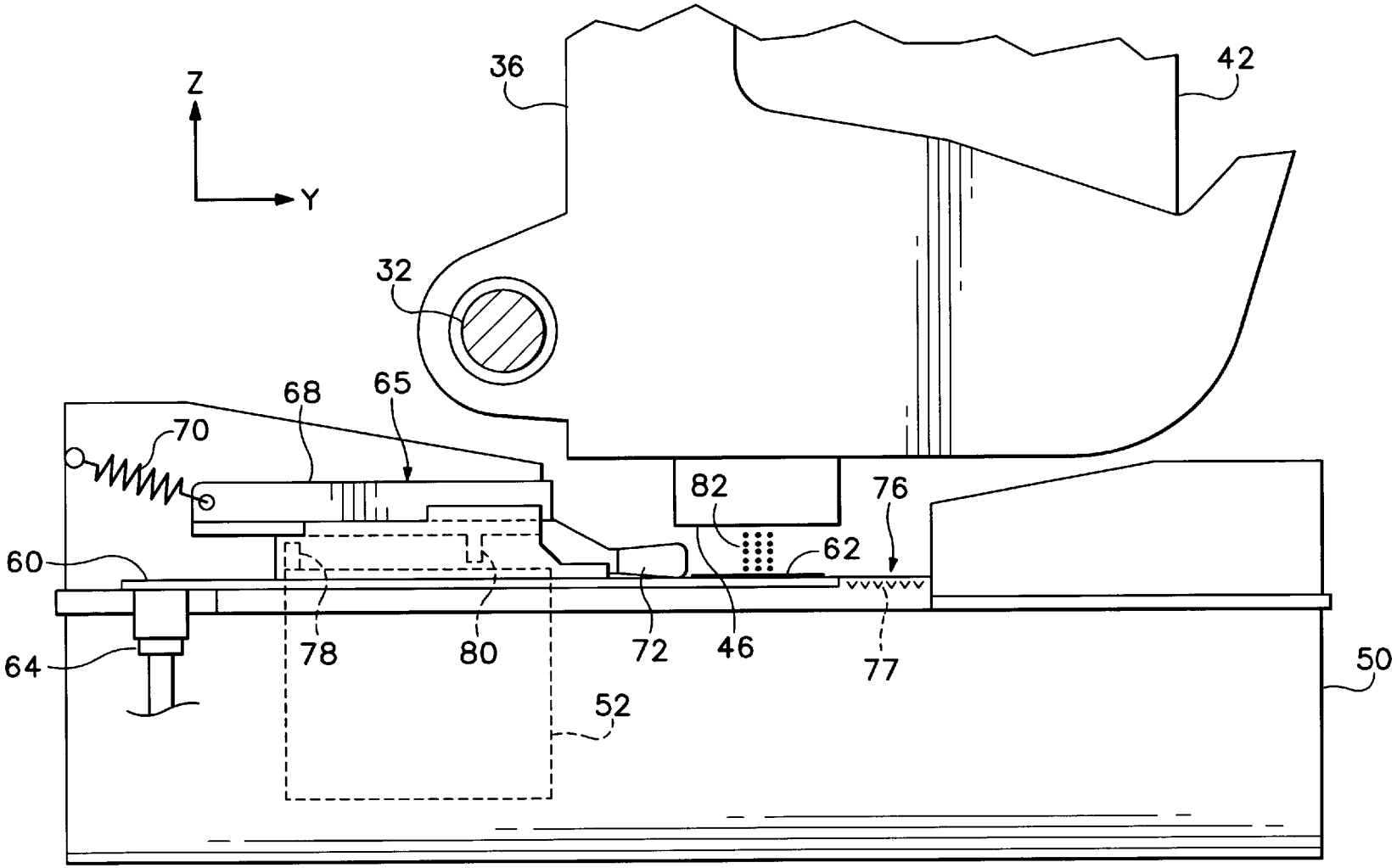
FIG. 3 is an enlarged side elevational view of the service station of FIG. 1 shown with an inkjet printhead firing ink onto the electrostatic ink drop detector.
Figure 4:
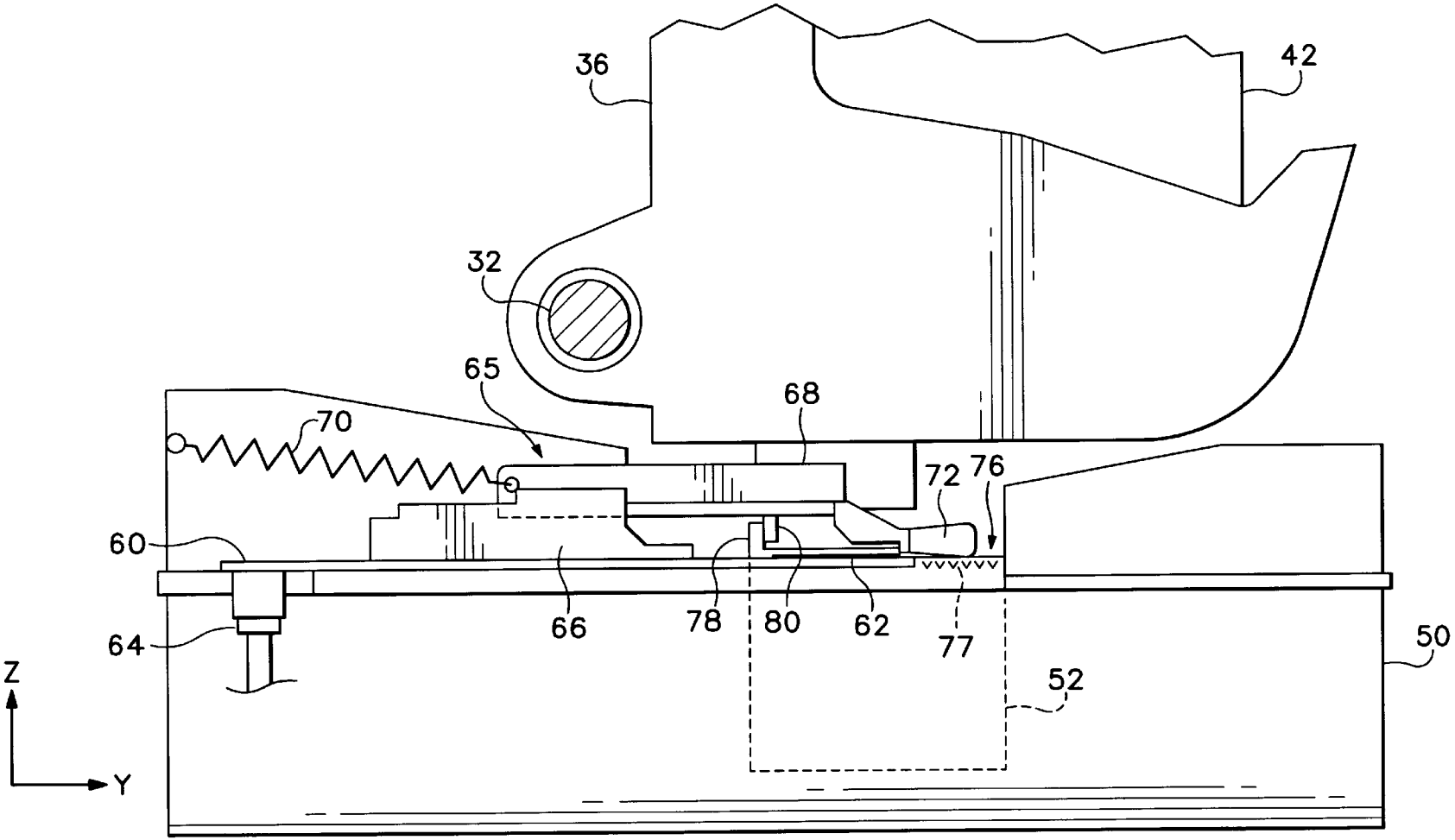
FIG. 4 is an enlarged side elevational view of the service station of FIG. 1, showing the electrostatic ink drop detector being cleaned by an embodiment of a waste ink removal system.

Movement is preferably imparted to the scraper slider 68 through movement of the moveable pallet 52 as the pallet 52 moves from the uncapped position shown in FIG. 3 to the capped position shown in FIG. 4. FIGS. 3 and 4 also show a moveable pallet tower 78 which protrudes upwardly from the moveable pallet 52 on the side of the moveable pallet 52 adjacent to the scraper slider 68. A scraper slider leg 80, which is integral to the scraper slider 68, protrudes inwardly and downwardly towards the moveable pallet 52. The moveable pallet tower 78 is sized and positioned to engage the scraper slider leg 80 as the moveable pallet 52 is moved from the uncapped position of FIG. 3. to the capped position of FIG. 4. The force exerted by the moveable pallet tower 78 on the scraper slider leg 80 is greater than the opposing force of the return spring 70, and moving the moveable pallet 52 causes the scraper slider 68 to move from the fully retracted position shown in FIG. 3 to the fully engaged position of FIG. 4. As the scraper slider 68 moves to the engaged position, the scraper 72 is scraped across the electrostatic target 62 and over the capillary drain surface 76, as shown in FIG. 4. The scraper 72 remains over the capillary drain surface 76 while the moveable pallet 52 is in the capped position. The capillary drain surface 76 may be designed so that it either contacts the scraper 72 or so that it does not contact scraper 72. In either case, ink will be scraped off of the target 62 and deposited onto the capillary drain surface 76 for further removal. When the moveable pallet 52 is returned to the uncapped position, the scraper slider 68 is also retracted due to the force of return spring 70. As moveable pallet 52 retracts, scraper 72 slides from the position shown in FIG. 4 over the capillary drain surface 76, back across the target 62, and into the retracted position shown in FIG. 3.

While the preferred method of actuating the scraper 72 is through the above-described movement of moveable pallet 52, it should be apparent that other mechanisms may be substituted to act as the actuator for the scraper 72, including, for example, a solenoid or a motor which operate in response to the controller 26.

While the moveable pallet 52 is in the uncapped position and the scraper 72 is in the retracted position, as shown in FIG. 3, the inkjet carriage 36 may be moved along the carriage guide rod 32 until one or more of the printheads 44, 46 are positioned directly over the electrostatic sensing target 62. For illustration purposes, the tri-color printhead 46 is shown positioned over target 62 in FIG. 3, although it is apparent that either of the printheads 44, 46 may be positioned over the target 62 either one at a time or in various simultaneous combinations if allowed by the size of the target 62, the size of each printhead, and the spacing between the printheads.

The preferred spacing between the printheads 44, 46 and the target 62 is on the order of two millimeters. Once the printhead 46 is properly aligned with the target 62, the controller 26 causes ink droplets 82 to be fired from printhead 46 onto the target 62. An electrical drop detect signal is generated by the ink droplets 82 as they contact the target 62, and this signal is captured by the electronics of PCA 60. The drop detect signal is then analyzed by controller 26 to determine whether or not various nozzles of printhead 46 are spitting ink properly or whether they are clogged. A preferred method of analyzing signals from an electrostatic target ink drop detector is shown in U.S. Pat. No. 6,086,190, also assigned to the present assignee, the Hewlett-Packard Company. Based on the determination made by the controller 26 as to whether each nozzle is functioning properly, the controller 26 may adjust the print masks to substitute functioning nozzles for any malfunctioning nozzles to provide consistent high-quality printed output while still using a printhead with permanently clogged nozzles.

In order to ensure that a reliable measurement may be made by the ink drop detector 58, it is desirable to remove ink residue from the target 62 after a measurement or series of measurements have been made to prevent excessive deposits of dried ink from accumulating on the surface of target 62. Dried ink deposits may short out the electrostatic sensing target 62, degrading the ability of the ink drop detector system 58 to make measurements. Additionally, dried ink deposits may accumulate over time to form stalagmites which may eventually grow to interfere with the printheads 44, 46, possibly damaging nozzles which hit the stalagmites, a process known as "stalagmite crashes."

Accordingly, the scraper 72 is scraped across the target 62 every time the moveable pallet 52 is moved to the capping position to seal the printheads 44-46 as described above. Prior to moving the pallet 52, the inkjet carriage 36 is preferably moved past the ink drop detector 58 and over the servicing region 38 until black printhead cap 54 aligns with black printhead 44, and tri-color printhead cap 56 aligns with tri-color printhead 46. When the printheads 44, 46 are aligned with the caps 54, 56 the scraper slider 68 and the scraper 72 are free to move without interference from the cartridges 40, 42 or the carriage 36.

The previously described motion of the scraper 72, as it traverses across the target 62 into the engaged position over the capillary drain surface 76, forces the wet ink from the target 62 onto the capillary drain surface 76 while also pushing away any built-up deposits of dried ink on the target 62 which might otherwise have begun to form stalagmites.

Figure 5:
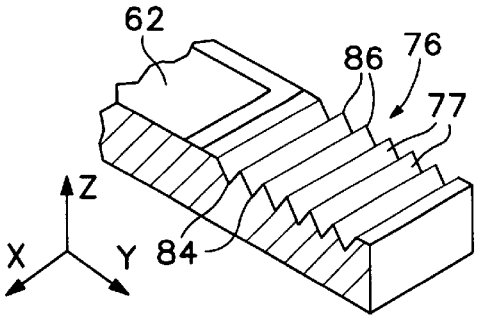
FIGS. 5–7 are cross-sectional partial perspective views of separate embodiments illustrating capillary drain surfaces.
Figure 6:
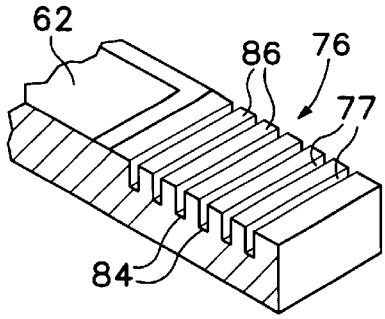
Figure 7:
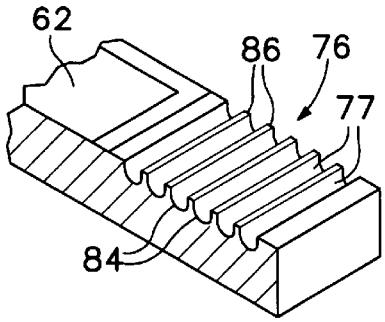
Figure 8:
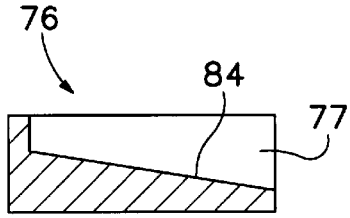
FIG. 8 is a cross-sectional view of the embodiment of a capillary drain surface illustrated in FIG. 9, taken along the lines indicated in FIG. 9.

FIGS. 5–7 illustrate example embodiments of the channels 77 which may be formed in the capillary drain surface 76. FIG. 5 illustrates channels 77 which are triangular in a cross-section taken parallel to the plane defined by the Z-axis and the Y-axis. FIG. 6 illustrates channels 77 which are rectangular in a cross-section taken parallel to the plane defined by the Z-axis and the Y-axis. FIG. 8 illustrates channels 77 which are arcuate in a cross-section taken parallel to the plane defined by the Z-axis and the Y-axis. Of course, many other cross-sectional shapes are possible, including cross-sectional shapes which vary in any given channel. The channels 77 illustrated in FIGS. 5–7 are exaggerated to show detail, but in practice, the dimensions of the channels 77 may be much smaller to facilitate the formation of a capillary drain 84 at the base of the channel 77, running the length of the channel 77. Channels 77 which come to a substantial point, such as the channels 77 illustrated in FIG. 5, may be rather large compared to the capillary drain 84 which will naturally form at the narrowed point of the triangular channel 77 cross-section taken parallel to the plane defined by the Z-axis and the Y-axis. It should also be noted that the cross-sections in FIGS. 5-7 are substantially orthogonal to the path fluid will follow, or "fluid path", in the capillary drains 84.

Figure 9:
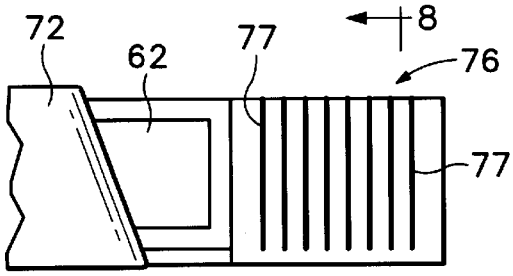
FIGS. 9–14 are partial plan views from the top of separate embodiments illustrating capillary drain surfaces.
Figure 10:
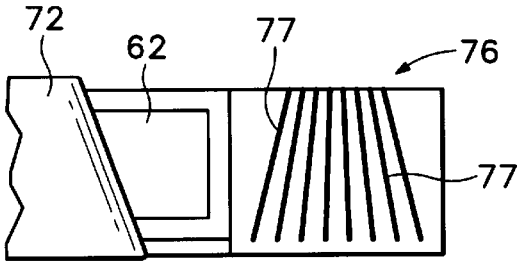
Figure 11:
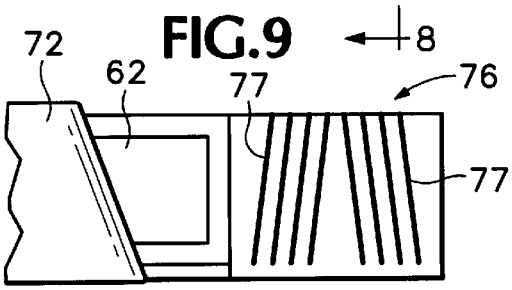

FIG. 8 is a cross-sectional view of an alternate embodiment of the capillary drain surface 76, taken along the lines indicated in FIG. 9. FIG. 8 illustrates that it may also be desirable to form the capillary drains 84 in the channels 77 with a slope which leads downward to the service station 48. Capillary drains 84 employing a slope similar to the embodiment of FIG. 8 will have the force of gravity to help ink to flow towards the service station 48 in addition to capillary forces, although capillary forces alone should be sufficient to remove the ink residue.

When the scraper 72 travels over the capillary drain surface 76, the scraper 72 may contact peak areas 86. It is also possible to design the peak areas 86 such that the scraper 72 does not contact the peak areas 86 when the scraper 72 is traveling over the capillary drain surface 76. The peak areas 86 lie between the channels 77, and form a plane which is substantially parallel with the plane target 62 lies in. Preferably, the peak areas 86 lie in substantially the same plane as target 62. The size of the peak areas 86 will vary depending on the size, cross-sectional shape, and spacing of the channels 77. As the moveable pallet 52 moves from the uncapped position in FIG. 3 to the capped position in FIG. 4, the scraper 72 is moved across the target 62 and over the capillary drain surface 76 as described above. Ink residue scraped by the scraper 72 is deposited into the channels 77. The liquid ink residue flows into the capillary drains 84 formed in the bottom of the channels 77 and flows through capillary force and gravity to the service station 48 where it can conveniently be stored. Other receptacles, besides the service station 48 may also be used to receive the ink from the capillary drains 84, such as a separate or stand-alone spittoon or receptacle. A separate spittoon or receptacle may also be used to separate the ink residue resultant from ink drop measurements from the ink residue which may otherwise be present in the service station 48. Solid ink residue is pushed by the scraper 72 onto the peak areas 86 of the capillary drain surface 76, and depending on the size of the solid ink residue with respect to the size of the channels 77, the solid ink residue may be partially pushed into the channels 77. The angled design of front edge 74 of scraper 72 will tend to sweep the solid ink residue off of the peak areas 86 and into the service station 48.

Figure 12:
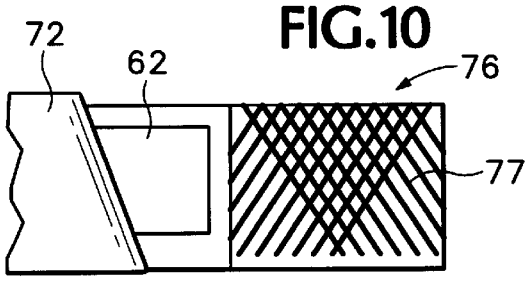
Figure 13:
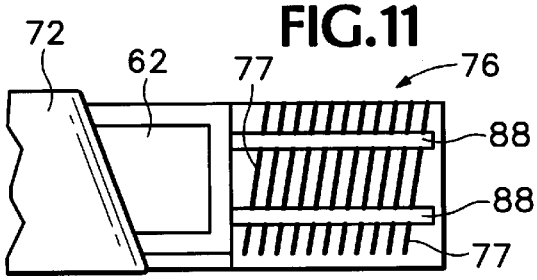
Figure 14:
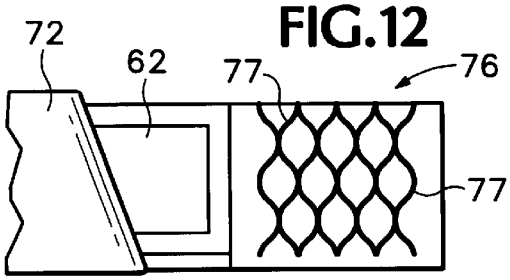

FIGS. 9–14 are a partial plan view from the top of the wiper 72, the target 62, the capillary drain surface 76, and illustrating several examples of patterns in which the channels 77 may be laid out. In FIGS. 9–14, the channels 77 are simplified by illustrating them as solid lines. There are numerous configurations of channels 77 which may be employed in a particular design for a capillary drain surface 76. For example, FIG. 9 illustrates channels 77, defined by the capillary drain surface 76, which are parallel. The channels 77 defined by the capillary drain surface 76 in FIG. 10 radiate outwardly from a single point. The channels 77 in FIG. 11 include a plurality of parallel sets of channels 77 defined by the capillary drain surface 76. The channels 77 in FIG. 12 include a plurality of parallel sets of channels 77 which intersect one another. The intersecting channels 77 of FIG. 12 provide alternate capillary paths for liquid ink in the event that one part of a channel 77 is blocked in some way. The embodiment of a capillary drain surface 76 illustrated in FIG. 13 includes manifold slots 88. The manifold slots 88 intersect the channels 77 and provide a place for the liquid ink residue to accumulate before being removed by channels 77. The manifold slots 88 also provide a means for the liquid ink to bypass channels 77, which may be blocked, by providing many channels 77 for the ink to contact in a given manifold slot 88. FIG. 14 illustrates channels 77 which are not linear. The channels of FIG. 14 are also not all parallel, and they intersect to allow a means to bypass portions of channels 77 which are blocked. Of course, there are many more configurations of channels 77 which may be formed in the capillary drain surface 76. The spacing between channels 77 may be varied from one capillary drain surface 76 to another, or the spacing may even be varied between individual channels 77 on the same capillary drain surface 76.

A printer control routine used by controller 26 is ideally adjusted to perform ink drop detection measurements just prior to capping. The immediately following process of moving the pallet 52 into the capping position activates the scraper 72, and the scraper 72 removes the ink from the target 62 while the ink is still wet, thereby minimizing the possibility that stalagmites or dried ink are forming on the target 62 and allowing the liquid ink residue to be removed by the capillary action of the capillary drains 84 which are formed in the channels 77 on the capillary drain surface 76.

When the moveable pallet 52 is moved to the uncapped position, scraper 72 is retracted by return spring 70, providing clearance for the inkjet carriage 36 to move along carriage guide rod 32 and into the printzone 30 for printing. Using information from the ink drop detector measurements, print masks may be adjusted to replace clogged nozzles for optimum image quality.

A waste ink removal system 65, used in conjunction with an electrostatic ink drop detector system 58, provides the ability to remove wet ink from the target 62 to the service station 48 before it dries. A waste ink removal system 65 also provides the ability to remove dried-ink buildup before it has a chance to form stalagmites, thereby preventing damage to the printheads 44, 46. Therefore, a waste ink removal system enables a printing mechanism to reliably use ink drop detection readings to provide users with consistent, high-quality, and economical inkjet output despite printheads 44, 46 which may clog over time. In discussing various components of the ink drop detector 58 and the service station 48, various benefits have been noted above.

It is apparent that a variety of other structurally equivalent modifications and substitutions may be made to construct an ink drop detector waste ink removal system according to the concepts covered herein depending upon the particular implementation, while still falling within the scope of the claims below.

I claim:

1. A waste ink removal system for cleaning ink residue from an ink drop sensor in a printing mechanism, comprising:

a base;

an actuator;

a scraper, supported by the base, which scrapes ink residue from the ink drop sensor when moved by the actuator from a retracted position to an engaged position; and a reservoir defining a plurality of capillary drains onto which the scraper deposits ink residue while moving to the engaged position.

2. The waste ink removal system according to claim 1 wherein the reservoir further defines channels which thereby define the plurality of capillary drains.

3. The waste ink removal system according to claim 2 wherein the channels are substantially triangular in a cross-section taken orthogonally to a fluid path of the capillary drains.

4. The waste ink removal system according to claim 2 wherein the channels are substantially rectangular in a cross-section taken orthogonally to a fluid path of the capillary drains.

5. The waste ink removal system according to claim 2 wherein the channels are substantially arcuate in a cross-section taken orthogonally to a fluid path of the capillary drains.

6. The waste ink removal system according to claim 1 wherein the capillary drains are substantially parallel to each other.

7. The waste ink removal system according to claim 1 wherein the capillary drains radiate outwardly from each other.

8. The waste ink removal system according to claim 1, wherein the scraper is angled to push ink residue towards a debris receptacle.

9. The waste ink removal system according to claim 1 wherein the base further comprises a guide cover which controls motion of the scraper between the retracted position and the engaged position.

10. The waste ink removal system according to claim 9 wherein the scraper further comprises:

a scraper slider which moves within the guide cover to support the scraper as it travels between the retracted position and the engaged position; and a spring member which biases the scraper slider towards the retracted position.

11. The waste ink removal system according to claim 10 wherein the spring member further comprises a bias component in a direction which minimizes a scraping force of the scraper to extend the life of the ink drop sensor.

12. The waste ink removal system according to claim 1 wherein the ink drop sensor comprises an electrostatic ink drop sensor.

13. The waste ink removal system according to claim 1 wherein the scraper contacts the reservoir when the scraper is in the engaged position.

14. The waste ink removal system according to claim 1 wherein the scraper does not contact the reservoir when the scraper is in the engaged position.

15. A printing mechanism, comprising:

a printhead which selectively ejects ink; and a waste ink removal system for cleaning ink residue from an ink drop sensor, comprising:

a base;

an actuator;

a scraper, supported by the base, which scrapes ink residue from the ink drop sensor when moved by the actuator from a retracted position to an engaged position; and a reservoir defining a plurality of capillary drains into which the scraper deposits ink residue while moving to the engaged position.

16. The printing mechanism according to claim 15 wherein the reservoir further defines channels which thereby define the plurality of capillary drains.

17. The printing mechanism according to claim 16 wherein the channels are substantially triangular in a cross-section taken orthogonally to a fluid path of the capillary drains.

18. The printing mechanism according to claim 16 wherein the channels are substantially rectangular in a cross-section taken orthogonally to a fluid path of the capillary drains.

19. The printing mechanism according to claim 16 wherein the channels are substantially arcuate in a cross-section taken orthogonally to a fluid path of the capillary drains.

20. The printing mechanism according to claim 15 wherein the capillary drains are substantially parallel to each other.

21. The printing mechanism according to claim 15 wherein the capillary drains radiate outwardly from each other.

22. The printing mechanism according to claim 15 wherein the base further comprises a guide cover which controls motion of the scraper between the retracted position and the engaged position.

23. The printing mechanism according to claim 22 wherein the scraper further comprises:

a scraper slider which moves within the guide cover to support the scraper as it travels between the retracted position and the engaged position; and a spring member which biases the scraper slider towards the retracted position.

24. The printing mechanism according to claim 23 wherein the spring member further comprises a bias component in a direction which minimizes a scraping force of the scraper to extend the life of the ink drop sensor.

25. The printing mechanism according to claim 15, wherein the ink drop sensor comprises an electrostatic ink drop sensor.

26. The printing mechanism according to claim 15 wherein the scraper contacts the reservoir when the scraper is in the engaged position.

27. The printing mechanism according to claim 15 wherein the scraper does not contact the reservoir when the scraper is in the engaged position.

28. A method for removing ink residue from an ink drop sensor in a printing mechanism, comprising:

moving a scraper between a retracted position and an engaged position;

scraping ink residue from the ink drop sensor with the scraper while moving to the engaged position; and depositing ink residue from the scraper surface onto a capillary drain surface while the scraper is in the engaged position.

29. The method according to claim 28 for removing ink residue, further comprising:

translating an inkjet printhead servicing member between a first position and a second position as an actuation to move the scraper between the retracted and engaged positions.

30. The method according to claim 29 for removing ink residue, further comprising biasing the scraper towards the retracted position.

31. The method according to claim 30 for removing ink residue, further comprising biasing the scraper in an additional direction to minimize a scraper force imparted by the scraper against the ink drop sensor.

32. The method according to claim 31 for removing ink residue further comprising:

after depositing ink residue from the scraper surface onto the capillary drain surface, moving the printhead servicing member from the second position back towards the first position; and allowing a spring member to retract the scraper towards the retracted position as the printhead servicing member moves back to the first position.

33. A waste ink removal apparatus, comprising:

a capillary drain surface which defines a plurality of channels; and a spittoon for receiving ink residue, wherein the channels are coupled to the spittoon.

34. The waste ink removal apparatus according to claim 33, wherein the capillary drain surface further defines a capillary drain in the channels.

35. The waste ink removal apparatus according to claim 34, wherein:

the channels have a cross-sectional shape; and a portion of the cross-sectional shape of the channels, as defined by the capillary drain surface, is substantially triangular.

36. The waste ink removal apparatus according to claim 34, wherein:

the channels have a cross-sectional shape; and a portion of the cross-sectional shape of the channels, as defined by the capillary drain surface is substantially rectangular.

37. The waste ink removal apparatus according to claim 34, wherein:

the channels have a cross-sectional shape; and a portion of the cross-sectional shape of the channels, as defined by the capillary drain surface is substantially arcuate.

38. A waste ink removal system for cleaning ink residue from an ink drop sensor in a printing mechanism, the system comprising:

a scraper configured to scrape ink residue from the ink drop sensor during relative movement of the ink drop sensor and the scraper; and a reservoir defining a plurality of capillary drains onto which the scraper deposits ink residue.

39. The system of claim 38 including an actuator configured to move at least one of the scraper and the ink drop sensor relative to one another.

40. The waste ink removal system according to claim 38 wherein the reservoir further defines channels which thereby define the plurality of capillary drains.

41. The waste ink removal system according to claim 40 wherein the channels are substantially triangular in a cross-section taken orthogonally to a fluid path of the capillary drains.

42. The waste ink removal system according to claim 40 wherein the channels are substantially rectangular in a cross-section taken orthogonally to a fluid path of the capillary drains.

43. The waste ink removal system according to claim 40 wherein the channels are substantially arcuate in a cross-section taken orthogonally to a fluid path of the capillary drains.

44. The waste ink removal system according to claim 38 wherein the capillary drains are substantially parallel to each other.

45. The waste ink removal system according to claim 38 wherein the capillary drains radiate outwardly from each other.

46. The waste ink removal system according to claim 38 wherein the capillary drains further comprise:

a first capillary drain which travels in a first direction; and a second capillary drain which travels in a second direction.

47. The waste ink removal system according to claim 46 wherein at least a portion of the first capillary drain intersects with at least a portion of the second capillary drain.

48. The waste ink removal system according to claim 38 wherein the capillary drains travel in substantially the same direction and wherein at least a portion of one capillary drain intersects with at least a portion of another capillary drain.

49. The waste ink removal system according to claim 38 wherein the reservoir further defines at least one manifold slot which intersects the capillary drains for the purpose of allowing liquid ink residue to collect before being removed to a service station by the capillary drains.

50. The waste ink removal system according to claim 38 wherein at least one of the capillary drains are sloped to allow gravity to assist capillary action in moving the ink residue to a receptacle.

51. The waste ink removal system according to claim 38, wherein the scraper is angled to push ink residue towards a debris receptacle.

52. The waste ink removal system according to claim 38 including a guide configured to guide relative movement of the scraper and the ink drop sensor.

53. The waste ink removal system according to claim 38 wherein the ink drop sensor comprises an electrostatic ink drop sensor.

54. A printing mechanism comprising:

a printhead configured to selectively eject ink;

an ink drop sensor; and a waste ink removal system including:

a scraper configured to scrape ink residue from the ink drop sensor during relative movement of the ink drop sensor and the scraper; and a reservoir defining a plurality of capillary drains onto which the scraper deposits ink residue.

55. The printing mechanism according to claim 54 wherein the reservoir further defines channels which thereby define the plurality of capillary drains.

56. The printing mechanism according to claim 55 wherein the channels are substantially triangular in a cross-section taken orthogonally to a fluid path of the capillary drains.

57. The printing mechanism according to claim 55 wherein the channels are substantially rectangular in a cross-section taken orthogonally to a fluid path of the capillary drains.

58. The printing mechanism according to claim 55 wherein the channels are substantially arcuate in a cross-section taken orthogonally to a fluid path of the capillary drains.

59. The printing mechanism according to claim 54 wherein the capillary drains are substantially parallel to each other.

60. The printing mechanism according to claim 54 wherein the capillary drains radiate outwardly from each other.

61. The printing mechanism according to claim 54 wherein the capillary drains further comprise:

a first capillary drain which travels in a first direction; and a second capillary drain which travels in a second direction.

62. The printing mechanism according to claim 61 wherein at least a portion of the first capillary drain intersects with at least a portion of the second capillary drain.

63. The printing mechanism according to claim 54 wherein the capillary drains travel in substantially the same direction and wherein at least a portion of one capillary drain intersects with at least a portion of another capillary drain.

64. The printing mechanism according to claim 54 wherein the reservoir further defines at least one manifold slot which intersects the capillary drains for the purpose of allowing liquid ink residue to collect before being removed to a service station by the capillary drains.

65. The printing mechanism according to claim 54 wherein at least one of the capillary drains are sloped to allow gravity to assist capillary action in moving the ink residue to a receptacle.

66. The printing mechanism according to claim 54 including a guide configured to guide relative movement of the scraper and the ink drop sensor.

67. The printing mechanism according to claim 54 wherein the ink drop sensor comprises an electrostatic ink drop sensor.

68. A method for removing ink residue from an ink drop sensor of a printing mechanism, the method comprising:

scraping ink residue from the ink drop sensor by moving at least one of a scraper and the ink drop sensor relative to one another; and depositing the ink residue onto a capillary drain surface.

69. The method according to claim 68 including moving a scraper relative to the ink drop sensor.

* * * * *